US011867488B1

(12) United States Patent
Williamson

(10) Patent No.: US 11,867,488 B1
(45) Date of Patent: Jan. 9, 2024

(54) SABOT FOR GUN LAUNCH PROJECTILE

(71) Applicant: Seth L. Williamson, King George, VA (US)

(72) Inventor: Seth L. Williamson, King George, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 18/073,899

(22) Filed: Dec. 2, 2022

Related U.S. Application Data

(60) Provisional application No. 63/418,318, filed on Oct. 21, 2022.

(51) Int. Cl.
*F42B 14/06* (2006.01)

(52) U.S. Cl.
CPC ..... *F42B 14/062* (2013.01); *F42B 14/068* (2013.01)

(58) Field of Classification Search
CPC ..... F42B 14/06; F42B 14/00; F42B 14/02; F42B 14/061; F42B 14/062; F42B 14/064; F42B 14/067; F42B 14/068; F42B 14/08
USPC ..... 102/521, 520, 522, 523, 528
See application file for complete search history.

(56) References Cited

U.S. PATENT DOCUMENTS

| | | | | | |
|---|---|---|---|---|---|
| 4,326,464 | A * | 4/1982 | Price | F42B 14/061 | 102/518 |
| 5,359,938 | A * | 11/1994 | Campoli | F42B 14/061 | 102/521 |
| H1412 | H * | 2/1995 | Kline | 102/521 | |
| H1999 | H * | 11/2001 | Newill | 102/521 | |
| 6,805,058 | B2 * | 10/2004 | Eches | F42B 14/061 | 102/521 |
| 6,829,997 | B1 * | 12/2004 | Hilleman | F42B 14/064 | 102/522 |
| 9,250,049 | B1 * | 2/2016 | DeMeester | F42B 14/067 | |
| 2010/0000439 | A1 * | 1/2010 | Baumann | F42B 14/064 | 102/521 |

* cited by examiner

*Primary Examiner* — John Cooper
(74) *Attorney, Agent, or Firm* — Gerhard W. Thielman

(57) ABSTRACT

From a plurality of sabots, a sabot is provided for shrouding a sub-caliber projectile to form a launch package in a gun bore for acceleration by an actuator behind the projectile. The sabot includes a forecastle, an aft bulkhead and a waist. The forecastle separates the projectile from the gun bore. The aft bulkhead abuts against the actuator. The waist connects the forecastle and the bulkhead by a radial spar that supports inner and outer flanges. The inner flange mechanically engages the projectile, and in preferred embodiments is concave. The gun bore is optimized as a pair of electromagnetic rails.

6 Claims, 11 Drawing Sheets

WIEW E-E

SECTION F-F

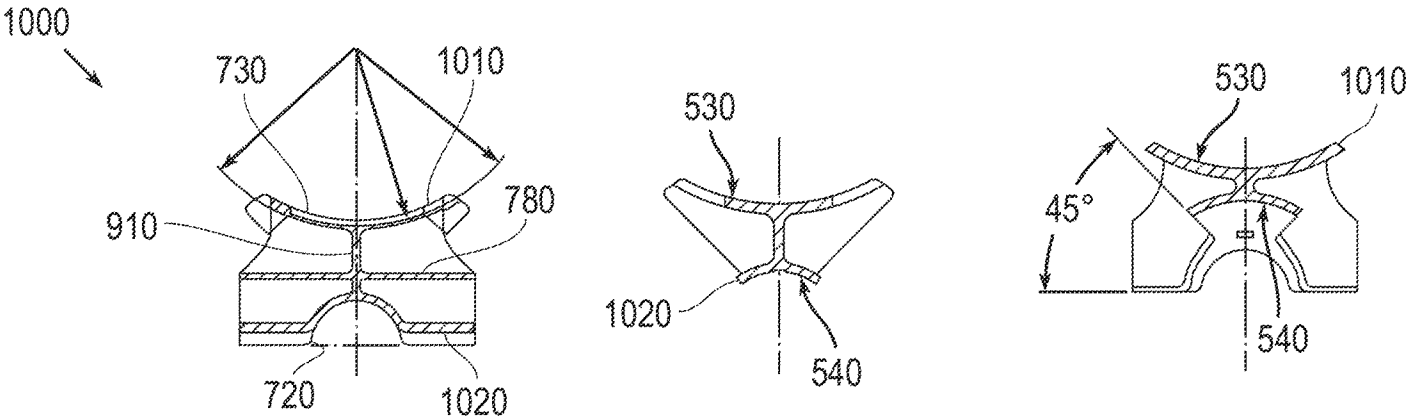
SECTION B-B
FIG. 10A
SECTION C-C
FIG. 10B
SECTION D-D
FIG. 10C
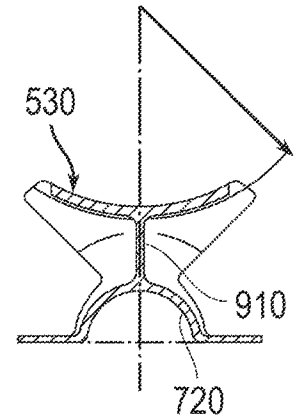
SECTION G-G
FIG. 10D
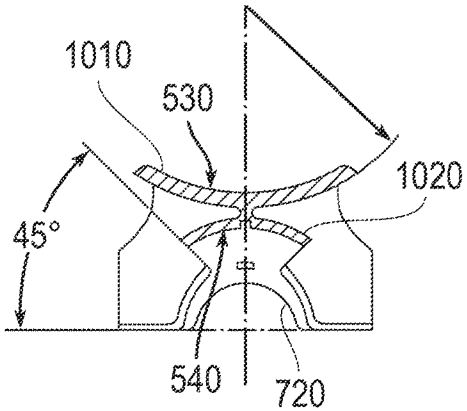
SECTION H-H
FIG. 10E

SABOT FOR GUN LAUNCH PROJECTILE

CROSS REFERENCE TO RELATED APPLICATION

Pursuant to 35 U.S.C. § 119, the benefit of priority from provisional application 63/418,318, with a filing date of Oct. 21, 2022, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to gun projectile sabots. In particular, the invention relates to a lightweight sabot design for protecting a narrow projectile while being launched from a high-speed gun platform.

In propellant-driven guns, projectiles must be launched via an explosive charge released on command to provide an expanding pressure wave. For electromagnetic railguns, such projectiles are accelerated via the Lorentz force from high voltage discharge across the rails.

Reductions in mass and frontal drag enable increase in exit velocity from the muzzle. However, material constraints limit pressure in the gun barrel, and similarly electrical conduction properties preclude endless increase of voltage application to rails. Hence to avail of reduced size while maintaining ample internal spacing, sabot petals are disposed around the munition projectile being ejected towards a target. Such sabot petals peel away from the projectile after exiting the muzzle and fall behind while the projectile continues its trajectory.

SUMMARY

Conventional projectile sabots yield disadvantages addressed by various exemplary embodiments of the present invention. In particular, various exemplary embodiments provide a plurality of sabots, in which the sabot shrouds a sub-caliber projectile in a gun bore to form a launch package for acceleration by an actuator behind the projectile. The sabot includes a forecastle, an aft bulkhead and a waist. The forecastle separates the projectile from the gun bore. The aft bulkhead abuts against the actuator. The waist connects the forecastle and the bulkhead by a radial spar that supports inner and outer flanges. The inner flange mechanically engages the projectile, and in preferred embodiments is concave. The gun bore is optimized as a pair of electromagnetic rails.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which:

FIGS. 10A, 10B, 10C, 10D and 10E are detail cross-section views of the I-beam structure.

DETAILED DESCRIPTION

Figure 1:
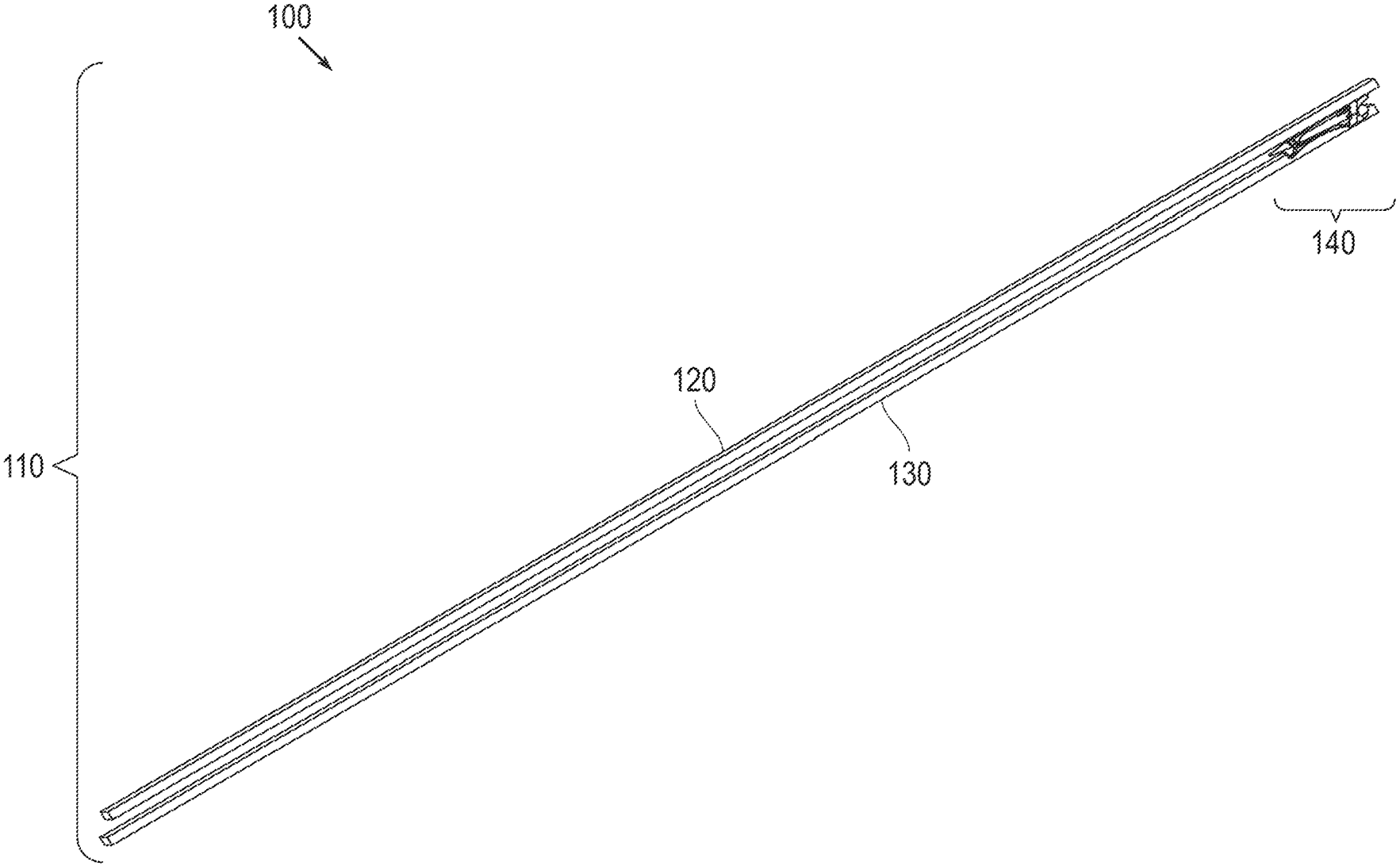
FIG. 1 is an isometric view of a rail gun for an exemplary launch package.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in meters (m) or inches ("), mass in grams (g) or pounds ($lb_m$), time in seconds (s), angles in degrees (°), force in newtons (N), temperature in kelvins (K), energy in joules (J), and frequencies in gigahertz (GHz). Supplemental measures can be derived from these, such as density in grams-per-cubic-centimeters ($g/cm^3$), moment of inertia in gram-square-centimeters ($kg\text{-}m^2$) and the like.

Previous conventional sabots developed by both Naval Surface Warfare Center-Dahlgren Division NSWCDD and BAE Systems utilized a thick-skinned sabot that wrapped around the projectile. These sabots had mid-ride support structures and cantilevered forward scoops of significant geometric complexity. Moreover, no I-beam cross section was used in these prior designs. Conventional designs were 35% to 57% heavier than the presently disclosed and exemplary "Nike" sabot geometry.

The "Nike" sabot geometry or architecture is realized as a sabot petal that enables a sub-caliber projectile, such as the Hyper Velocity Projectile (HVP) to interface with the inner surfaces of the electromagnetic railgun bore. The sabot petals form majority of the structural support assemblage known as the integrated launch package (ILP). The ILP is responsible for supporting the projectile during launch.

The "Nike" sabot provides structural support for the HVP under intense compressive (setback) loads and balloting (lateral) loads in the gun. The "Nike" also cleanly discards away from the projectile at muzzle exit without interfering with the projectile's flight. The "Nike" sabot's primary function is to provide structural support and clean discard from a munition projectile, such as HVP, using a minimal mass of material during launch.

NSWCDD has invested in re-purposing remaining hardware from the Electromagnetic Railgun (EMRG) program into a hypersonic test asset. The railgun provides a ready, cost-effective, and consistent means of obtaining hypersonic launch that can be used to facilitate the testing and design of materials, control surfaces, and flight bodies in the development of hypersonic weapons.

In order to maximize the potential of the railgun for this purpose, the "Nike" integrated launch package (ILP) was created. The Nike ILP enables existing proven airframe configurations (aerothermal, maneuvering, telemetry, etc.) to be launched at previously unobtainable velocities and demonstrates the ability of NSWCDD to optimize ILP design to maximize the hypersonic testing utility of railgun. This disclosure describes the innovative design methodologies and technologies that led to the successful testing of the Nike ILP during the Hypersonic Commissioning Campaign at White Sands Missile Range (in New Mexico) in February 2022.

The "Nike" geometry or architecture exploits an I-beam cross section with convexly opposed flanges, thin sections, and a simplified front scoop to significantly reduce sabot parasitic mass, resulting in significantly increased muzzle velocity when fired from an electromagnetic railgun (ERMG).

This results in expansion of the hypersonic utility of the electromagnetic railgun and enables economical, cost-effective collection of real-world flight data over a larger range of flight regimes. Artisans of ordinary skill will recognize that while the particular geometries of the exemplary embodiments focus on compatibility with the EMRG, the principles of this design can also be applied to a pressure-driven cylindrical-bore propellant initiated gun, such as have been developed over the past several hundred years.

FIG. 1 shows an isometric view 100 of an exemplary railgun 110, which includes proximal (upper) and distal (lower) rails 120 and 130. Using the Lorentz force, electromagnetic current accelerates an integrated launch package (ILP) 140 along the rails 120 and 130 for ejection at hypersonic velocities.

Figure 2:
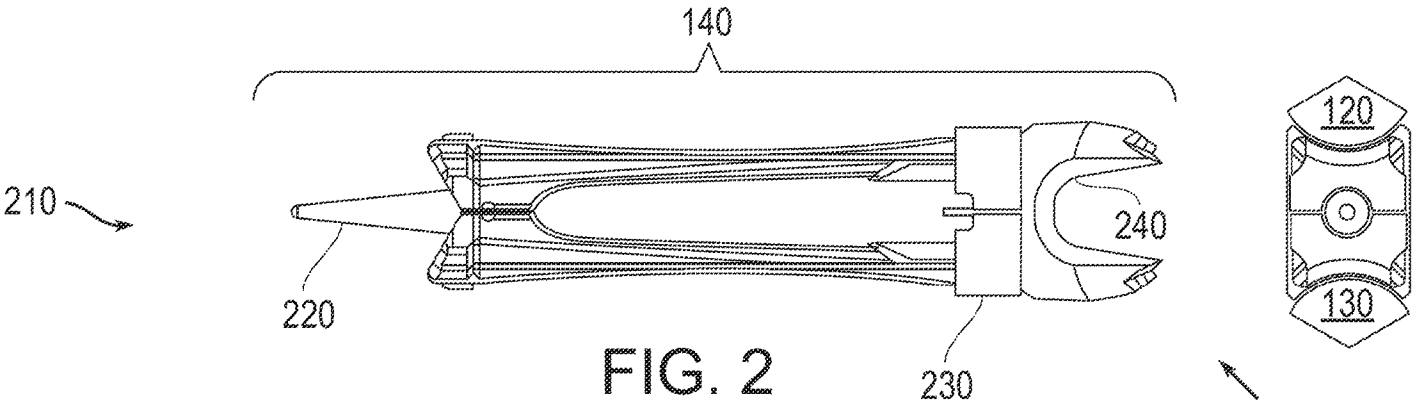
FIG. 2 is a set of elevation views of an exemplary launch package.

FIG. 2 shows elevation detail views 200 of an exemplary launch package 140 between the rails 120 and 130 that form a bore 210 for accelerated travel. The launch package 140 to be boosted includes a munition projectile 220, an aft bore rider 230 and an armature 240, along with the sabot described subsequently. The aft bore rider 230 provides a low friction launch package gun bore interface that centers the launch package 140 while traveling along the bore 210. The armature 240 serves as an electrical conduit to close the circuit when current courses through the rails 120 and 130. The projectile 220 has a secant ogive geometry and absent buffering elements at its forebody (e.g., front section 610), would tumble between the rails 120 and 130.

Figure 3:
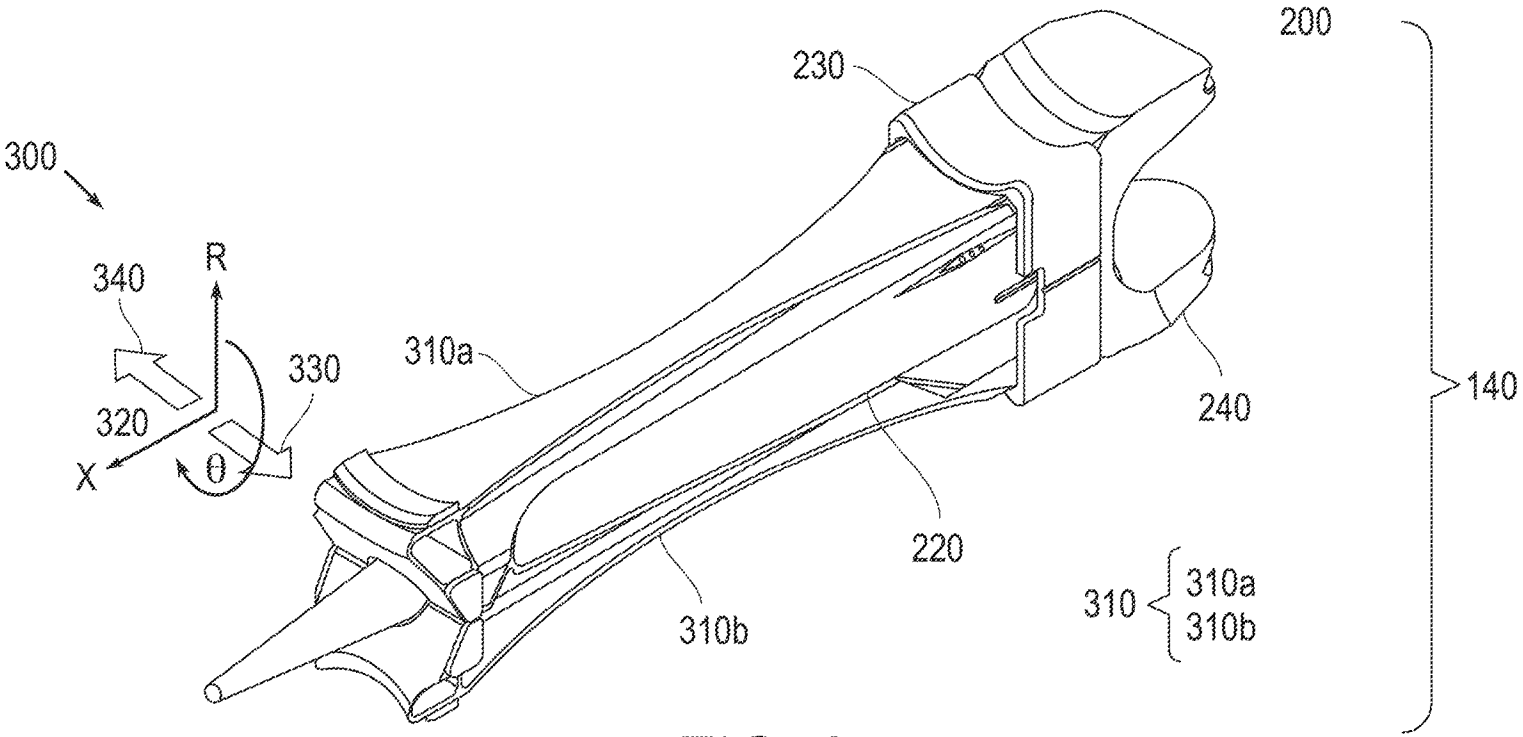
FIG. 3 is an isometric assembly view of the launch package.

FIG. 3 shows an isometric assembly view 300 of the launch package 140. A pair of exemplary sabots 310, labeled 310*a* and 310*b*, envelope the projectile 220 and are disposed ahead of the aft bore rider 230 and the armature 240. These proximal and distal sabots 310*a* and 310*b* are geometrically and materially identical, being vertically inverted from each other to receive the projectile 220. A variety of design constraints render a pair of identical sabots 310 around the projectile 220 preferable. However, this characteristic is not limiting as an alternative plurality above two is within the scope of the claims.

A polar compass rose 320 identifies axial (X), radial (R) and angular (θ) directions related to the launch package 140. Each sabot 310 is bilaterally symmetric between port 330 and starboard 340. The sabots 310 are machined by milling from aluminum 7075-T651. Artisans of ordinary skill will recognize that the production technique and material composition are exemplary and not limiting. Nonetheless, these selected aspects are considered practical due to design constraints and material property and compatibility requirements for the railgun 110.

Figure 4:
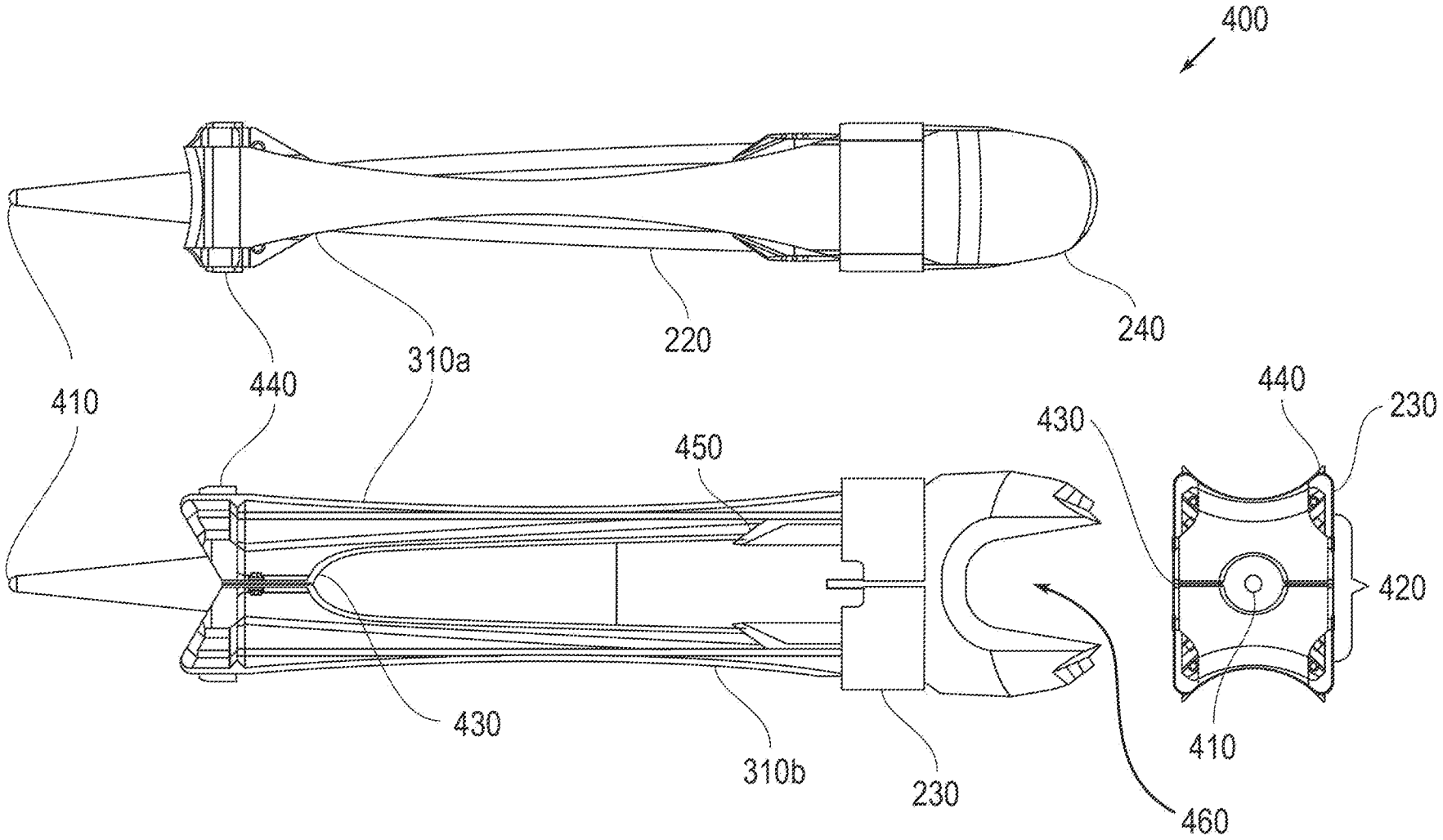
FIG. 4 is set of plan and elevation views of the launch package.

FIG. 4 shows plan and elevation assembly views 400 of an exemplary launch package 140. The projectile 220 includes a nose tip 410 that protrudes from the sabots 310, which combined form a separable housing 420 that divide at the joining interfaces 430. At the forebody of the housing 420 are curved insert panels 440 that engage the rails 120 and 130. The edges of the panels 440 align collinearly with the corners of the aft bore rider 230. The projectile 220 includes aft fins 450 for aerodynamic stability, and these are accommodated by the housing 420 and the aft bore rider 230. The armature 240 ends in a fork 460 featuring a gap that directs electric current while reducing mass.

Figure 5:
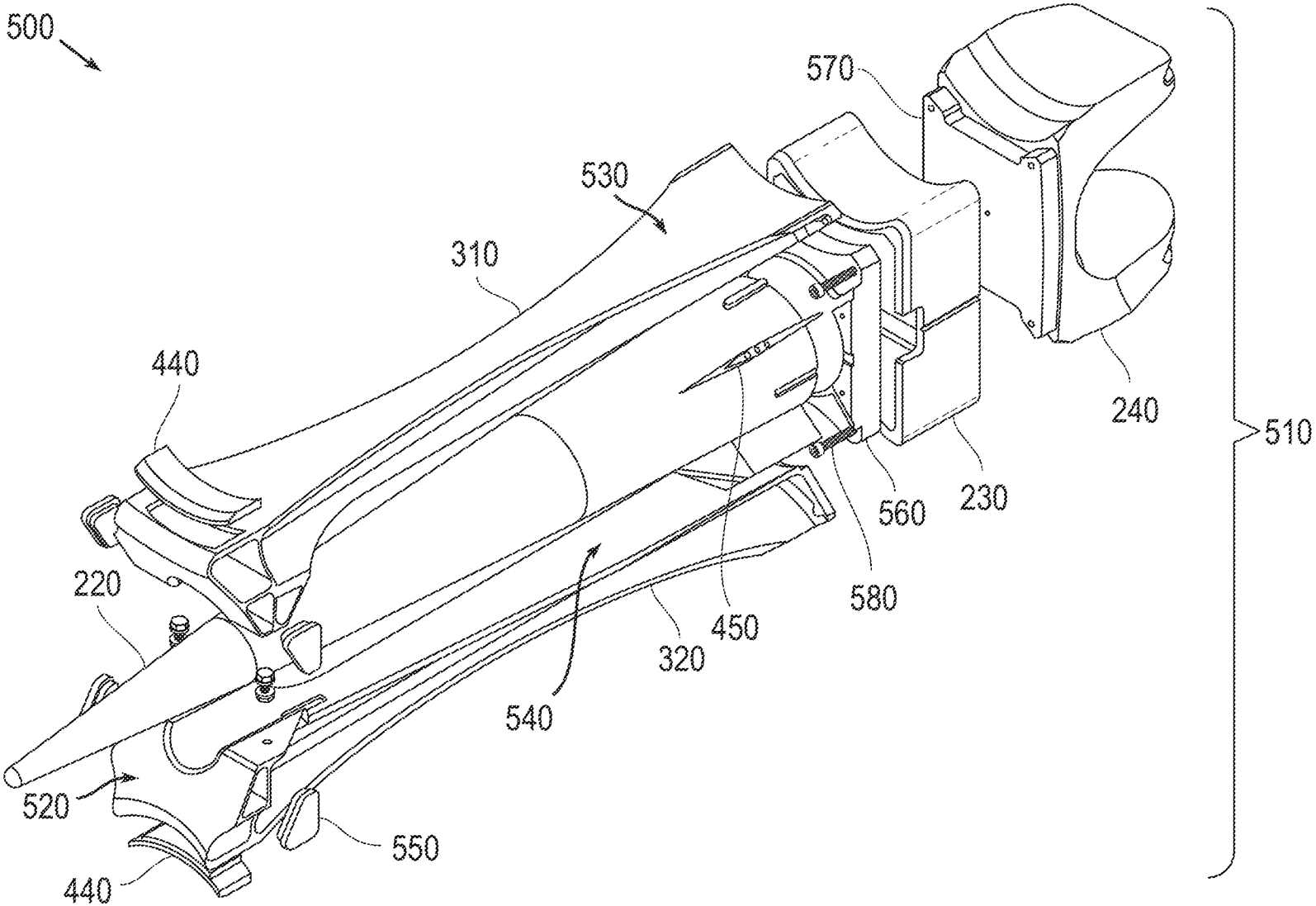
FIG. 5 is an isometric exploded view of the launch package.

FIG. 5 shows an isometric exploded view 500 of components 510 of the launch package 140. The sabots 310 include a fore surface 520, each forming a half-circle cutout (720) to cradle the projectile 220. Each sabot 310 has an outer surface 530 that faces one of the rails 120 or 130 and an inner surface 540 that faces the projectile 220. Each of the outer and inner surfaces 530 and 540 presents a concave saddle.

A set of four bore contact panels 550 can be inserted into the housing 420. First and second load transfer interfaces 560 and 570 are axially disposed with the aft bore rider 230 therebetween. The first load transfer interface 560 is disposed behind the projectile 220. The second load transfer interface 570 is disposed ahead of the armature 240. A set of bolts 580 fasten the interfaces 560 and 570 together. The armature 240, the aft bore rider 230, and the interfaces 560 and 570 constitute an actuator. For a conventional gun, such an actuator could include the propellant casing.

Figure 6:
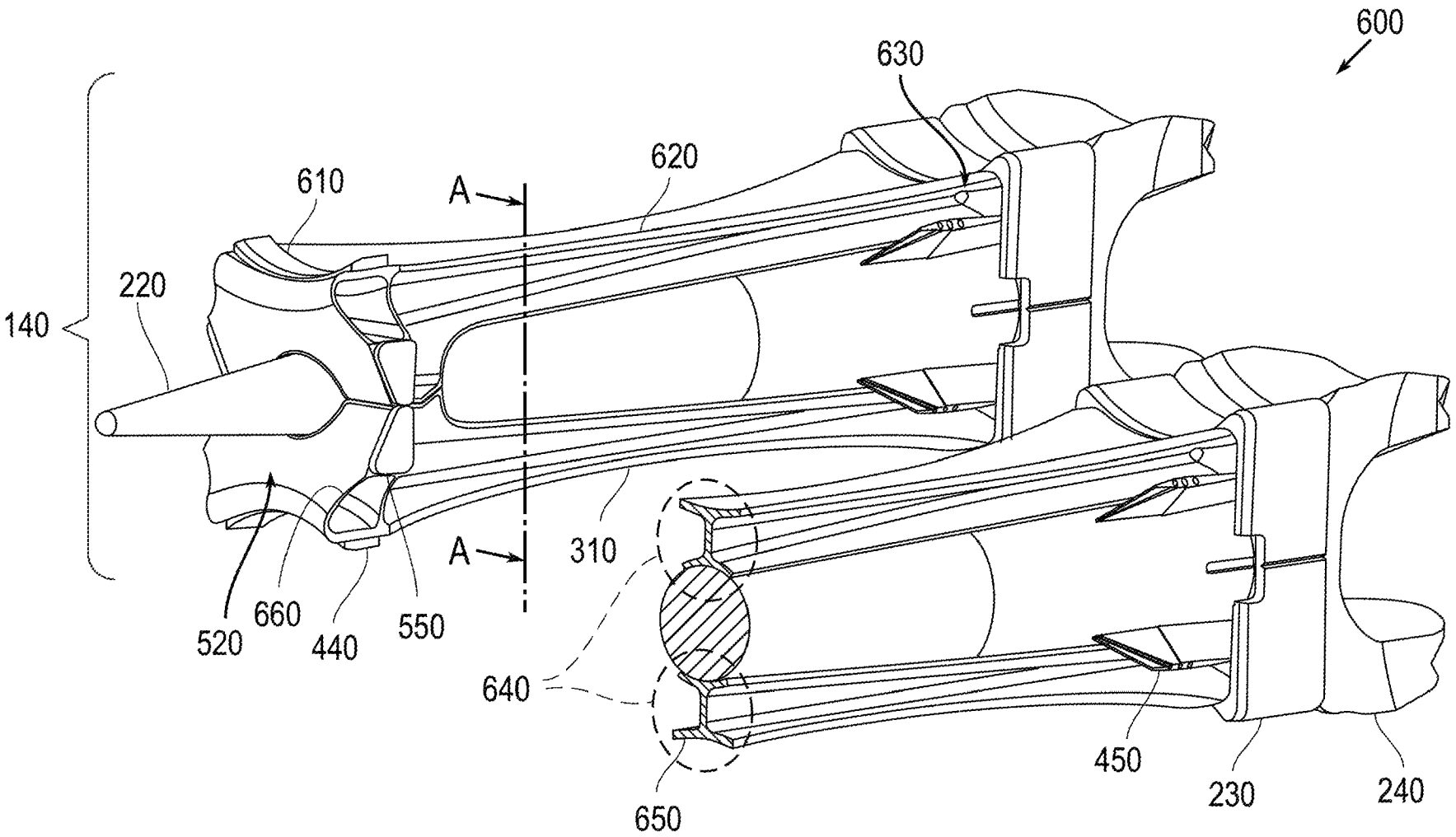
FIG. 6 is a set of isometric assembly and cross-section views of the launch package.

FIG. 6 shows an isometric view 600 of the launch package 140 including cross-sectional near the mid-section. The sabot 310 can be descriptively subdivided into a forecastle or front section 610, a waist or midsection 620 and a rear section 630. A cross-section 640 through line A-A shows an I-beam profile 650. The sabot 610 includes portions of thin flanges, such as foreplate 660 from which the outer surface 520 emerges.

Figure 7:
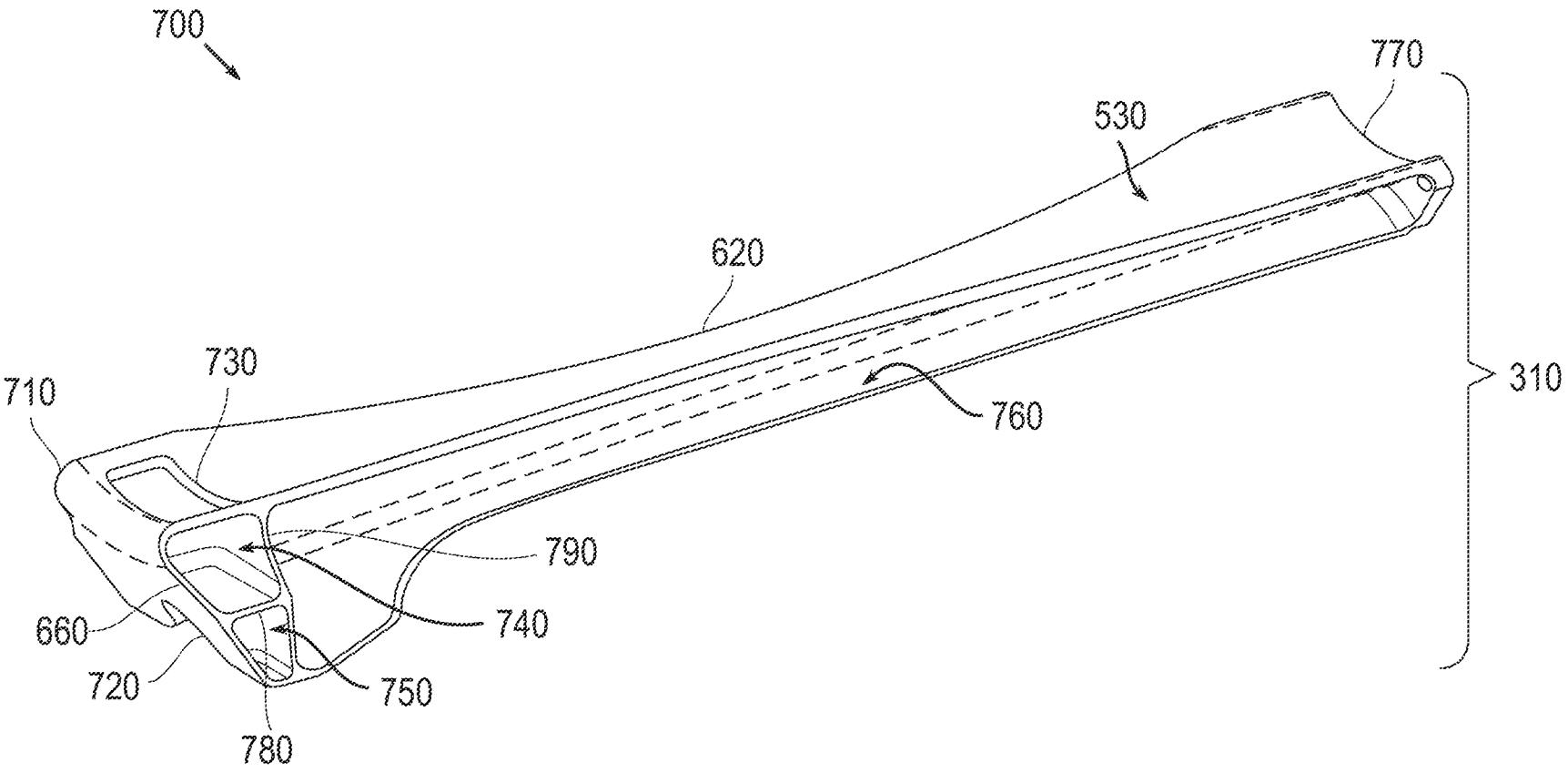
FIG. 7 is an isometric view of an exemplary sabot.

FIG. 7 shows an isometric view 700 of an exemplary sabot 310, having a length for this configuration of almost 20 inches and a mass of about 1.59 $Ib_m$ to accommodate the projectile 220 with a 3.25 inches base diameter. The front section 610 features a rounded saddle bow 710 in front of the fore surface 520 that includes the half-circle cutout 720. The front section 610 also includes as a rectangular profile cavity 730 facing radially outward that receives one of the two insert panels 440 for the housing 420 and two lateral windows 740 and 750, of which each of the latter receives one of the contact panels 550.

The mid-section 620 includes adjacent chambers 760 bounded by the profile 650. The rear section 630 includes a flat stern 770 that abuts the first spacer 560. The sabot 310 is bilaterally symmetric, such port 330 and starboard 340 divisions each include an outer front window 740, an inner front window 750, and an elongated chamber 760. A lateral wall 780 divides the windows 740 and 750 from each other. A radial wall 790 divides the windows 740 and 750 from the chambers 760.

Figure 8A:
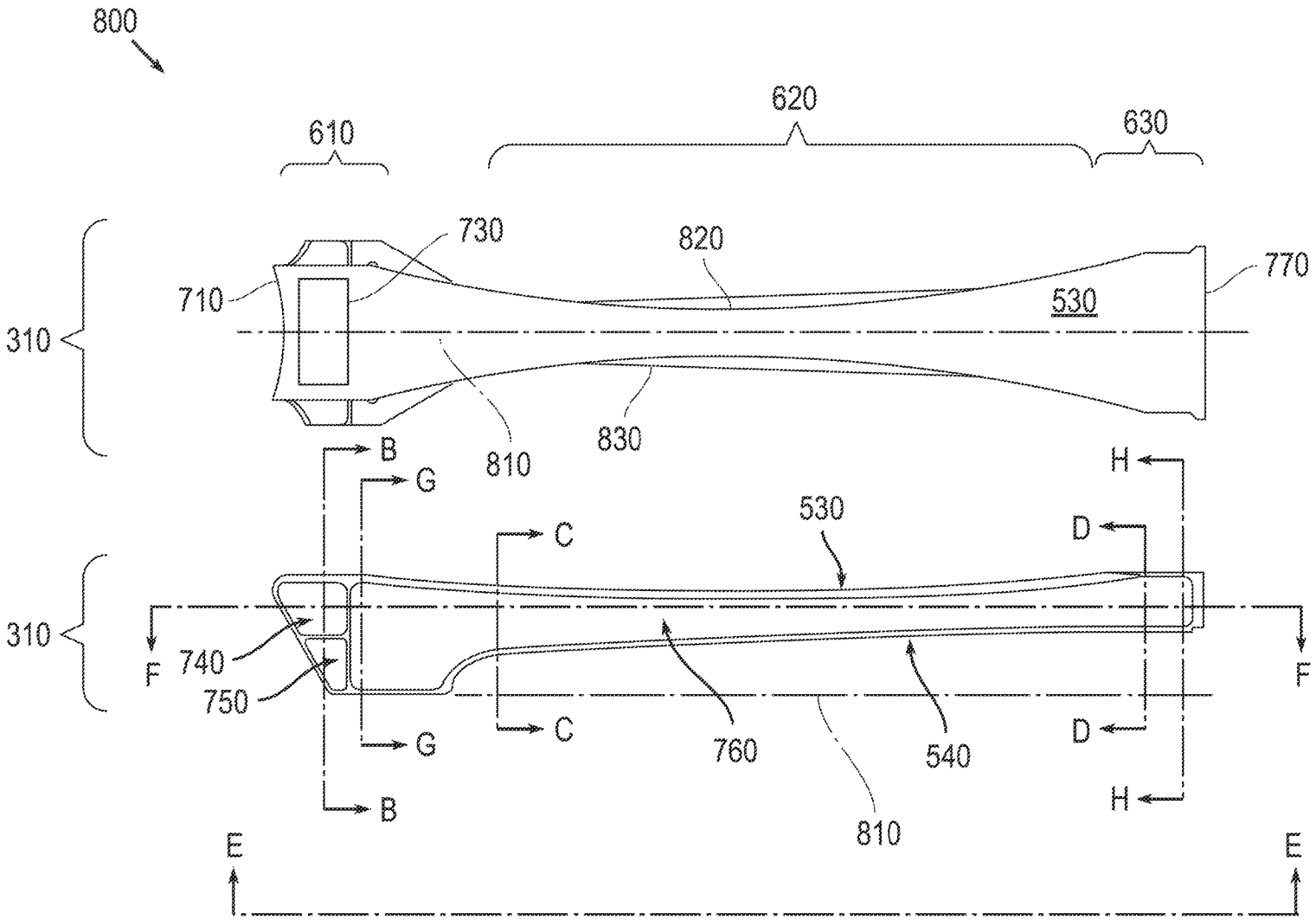
FIGS. 8A and 8B are plan and elevation views of sabot geometry.
Figure 8B:
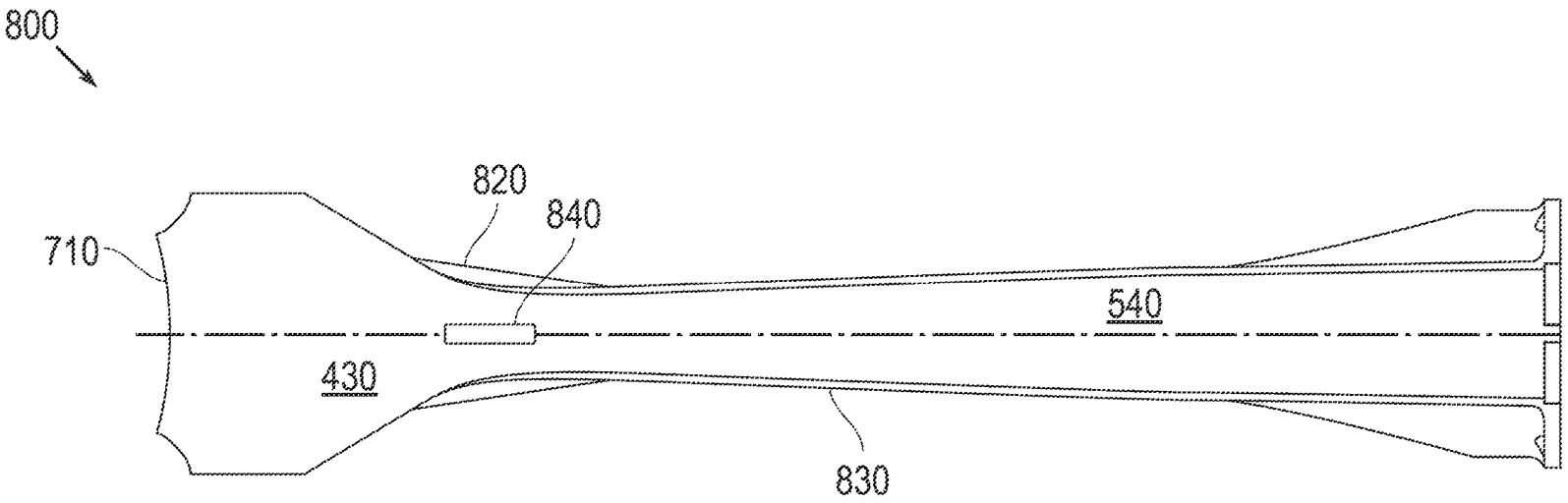

FIGS. 8A and 8B show design views 800 of the sabot 310, including elevation and plan perspectives. The sections 610, 620 and 630 are distinguished along with bow 710 and stern 770, and the cavity 730 and windows 740 and 750 are geometrically identified. An axial centerline 810 corresponding to that of the projectile 220 provides a reference for bilateral symmetry of the sabot 310. To avoid personnel injury, all corners and edges are rounded.

Several sectional views are displayed: along the axis from inner-to-outer: E-E; outer-to-inner: F-F; through the axis from fore-to-aft: B-B, G-G and C-C; and from aft to fore: H-H and D-D. The plan view 800 in FIG. 8A shows the sabot 310 from the rail side with outer curve profile 820 for mid-section 620. FIG. 8B shows the sabot 310 as sectional view E-E from the projectile side with inner straighter profile 830 for mid-section 620. A slot 840 receives a thin foam pad that serves to promote tight packing of the launch package and dampen vibrations imparted to projectile 220 during launch.

Figure 9A:
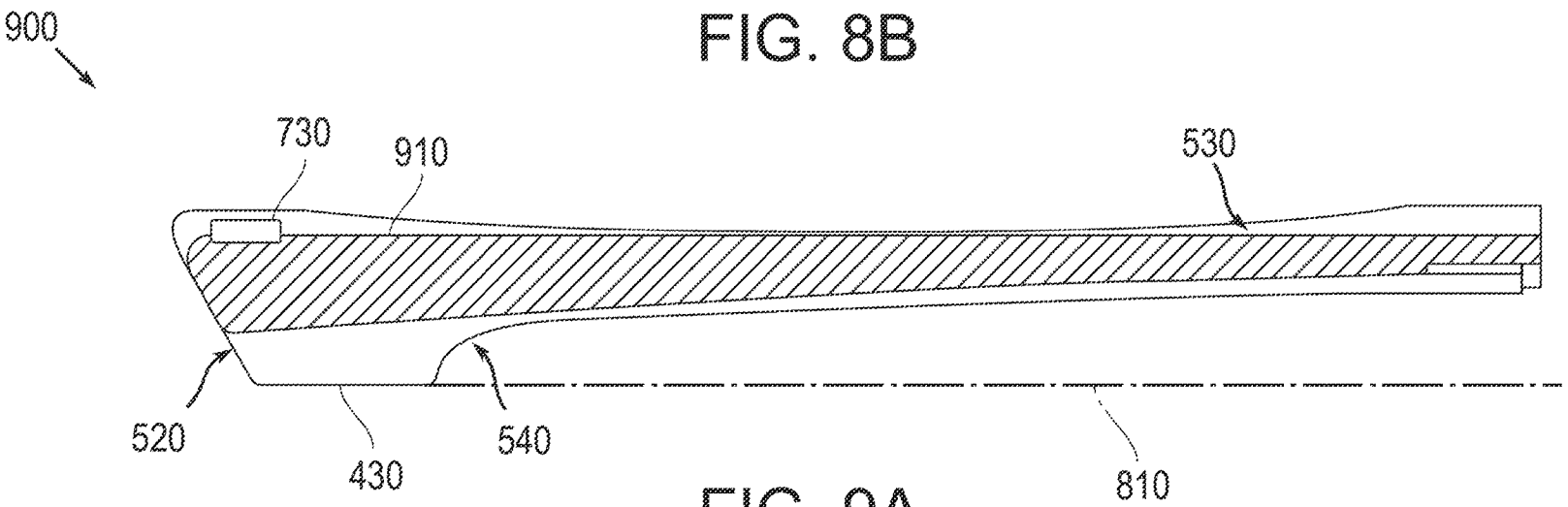
FIGS. 9A and 9B are plan and elevation views of sabot geometry.
Figure 9B:
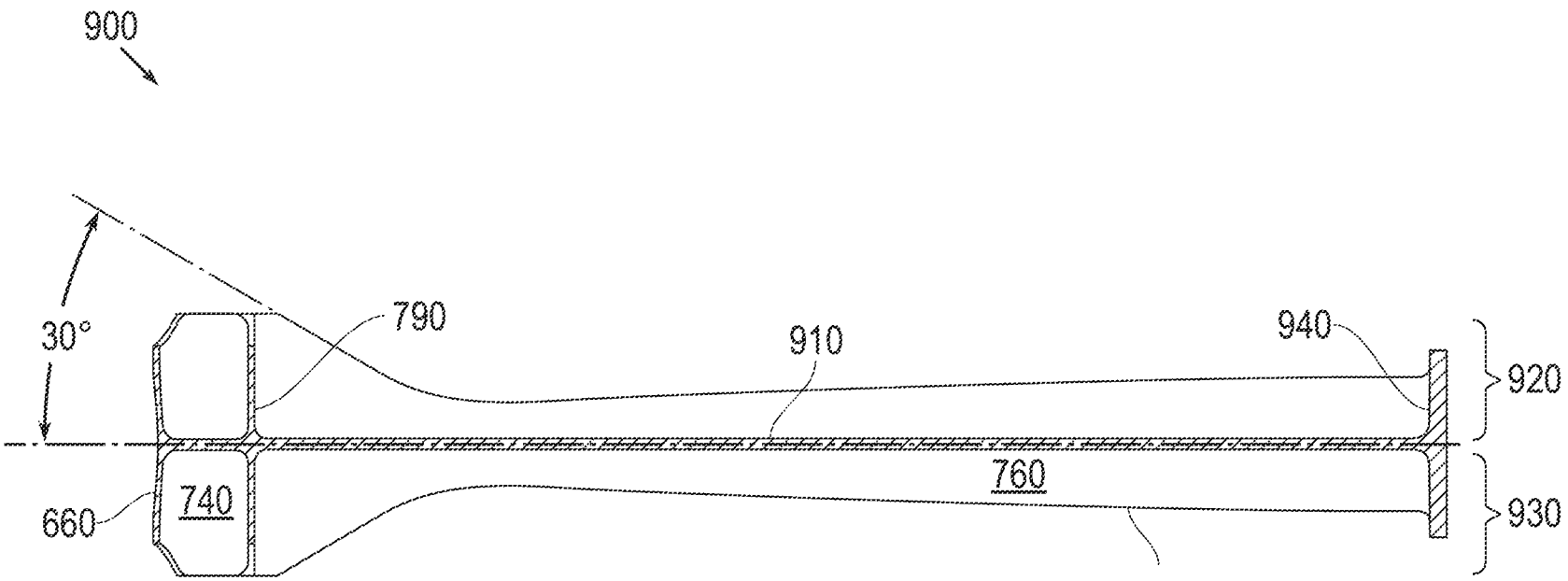

FIGS. 9A and 9B show cross-sectional views 900 of the sabot 310 including elevation and plan perspectives. A center spar 910 extends radially from the inner surface 540 to outer surface 530, and axially from bow 710 to stern 770 as a column for the I-beam profile 650. The spar 910 separates port 920 and starboard 930 portions in relation to its port 330 and starboard 340 bilateral symmetry. The radial wall 790 provides a boundary for the windows 740 in the front section 610 and the chambers 760 of the waist or mid-section 620. A bulkhead 940 provides the terminus to the rear section 630.

Aft of the windows 740, the inner profile 820 forms a 30° angle from the axial centerline 810 decreasing width from the front section 610 until re-extending laterally towards the rear section 630. The fore surface 520 forms a 60° angle slope from the axial centerline 810 so as to extend radially outward with increasing forward distance from the stern 770. The spar 910 varies in radial height R to the centerline 810 with respect to distance X forward from the stern 770 by the following relations with height R(Y) as a function of intermediate parameter Y(X), which in turn is a function of distance X:

$$R=0.9168\cdot[Y-\tfrac{1}{2}\sin(2Y)]^{1/2},$$

and $$Y=\arccos[0.0392046-(1.43379+0.078409\cdot X)].$$

FIGS. 10A, 10B, 10C, 10D and WE show detail cross-section views 1000 of the sabot 310 along select positions between the bow 710 and stern 770. In particular, FIG. 10A features section B-B, FIG. 10B features section C-C, FIG. 10C features section D-D, FIG. 10D features section G-G, and FIG. 10E features section H-H. Each section features an outer flange 1010 and an inner flange 1020 joined by the spar 910. The flanges 1010 and 1020 extending axially to present respective surfaces 530 and 540 exhibit varying concave curvatures, and the spar 910 varies in radial height along the extent of the sabot 310, depending on structural loads and local radius of the projectile 220.

Figure 11:
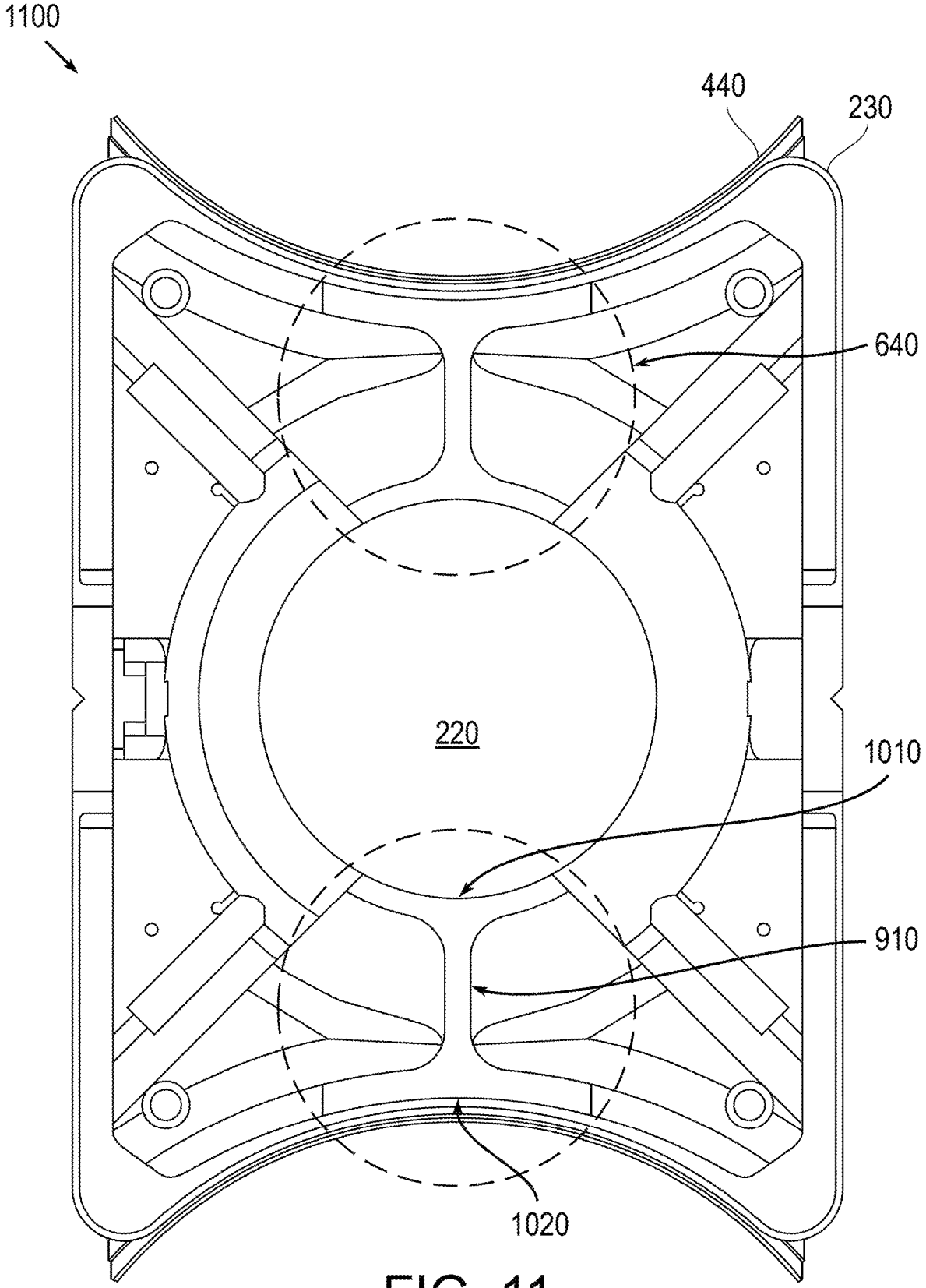
FIG. 11 is cross-section view of the launch package.

FIG. 11 shows a cross-section view 1100 of the launch package 140 from section A-A as detail 640 with the projectile 220 in the center, enveloped towards aft by the aft bore rider 230 and fins 450, and towards fore by the panels 440. As consistent with view 1000, the curved flanges 1010 and 1020 present opposing concave shapes in relation to and being joined at their centers by the spar 910. These concave shapes mean that the inner flange 1020 follow a constant radius with angular sweep, while the outer flange 1010 extends radially outward as angle increases from the spar 910. Typically, the inner flange 1020 has a smaller radius of curvature than the outer flange 1010, and in any case is designed so the inner surface 540 conforms to the casing of the projectile 220 along their shared lengths.

Exemplary embodiments of the Lightweight I-Beam Sabot 310 is an effective marriage of established structural design concepts with conventional materials and fabrication methods in a novel sabot architecture that significantly reduces parasitic mass in high-performance gun systems. In the instant disclosure, high-performance generally refers to the attainment of launch velocities that are higher than those typically achievable for a conventional gun system. Higher launch velocities for gun systems employing sub-caliber projectiles are often obtained through parasitic mass reduction in the supporting sabot system.

For a given gun driving force profile, mass reduction of the sabot 310 translates to increased acceleration and thus higher launch velocity. This is due to shift in distribution of total kinetic energy to the launch package 140, which is a function of mass multiplied by the square of the velocity. With lighter sabots 310, the accompanying reduction in mass of the launch package 140 causes increase in velocity. The exemplary concept was conceived, designed, and implemented for parasitic mass reduction in existing 32 MJ electromagnetic railgun systems firing sub-caliber projectiles, although such a sabot 310 has potential applications to other conventional gun systems.

The innovative implementation of I-beam architecture into the subject sabot 310 has resulted in sabot mass that is 35% less than the existing prior best efforts as known to the inventor. The higher launch velocities obtained through sabot mass reduction are of considerable military value. Faster launch corresponds to faster threat response time, greater maneuverability to engage threats, improved effective range, and enhanced lethality effects on target. The parasitic mass reduction afforded by the subject sabot architecture can increase the utility of both existing and future gun weapon systems.

Exemplary embodiments of the Lightweight I-Beam Sabot 310 were conceived, designed, and implemented for parasitic mass reduction in existing 32 MJ electromagnetic railgun (EMRG) systems firing sub-caliber projectiles. Two of these sabots 310*a* and 310*b* are required per sub-caliber launch package 140 in order to adequately support the projectile 220 between the rails 120 and 130. Each sabot 310 is essentially an assemblage of thin shell structures machined from a single billet of material—preferably aluminum alloy 7075-T651 as presently implemented. Other materials can satisfy material properties for structural integrity, although cost would be a concern. Alternative fabrication techniques to produce the design shape are not precluded, although implementation could affect cost variation depending on the produced quantity.

Viewing a cross-section of the launch package 140 in the railgun bore from the front, the sabot design space is constrained by the opposing convex outer surfaces of the projectile flight body and railgun rails 120 and 130. The sabot 310 makes efficient use of this space by employing opposing mating concave shell structures connected by a vertical bridging shell structure. The resulting sabot cross-section is reminiscent of a traditional I-beam structure, albeit with opposing concave flanges 1010 and 1020, rather than the traditional flat flange sections. In particular, the inner flange 1020 must be concave to conform to the geometry of the projectile 220. The outer flange 1010 is preferably concave to reduce twist distortion away from the front 710 and rear 770 ends.

In engineering, I-beam cross-sections are widely used in the structural design community to carry compressive, bending, and torsional loads for minimal weight, material, and cost in building construction. The railgun launch environment imparts similar compressive (setback), bending (aerodynamic discard and rail-rail balloting), and torsional (insulator-insulator balloting) loads upon the launch package, making the core I-beam geometry particularly well suited to carrying such loads efficiently with minimal mass in the railgun.

The geometric constraints of the railgun launch package 140 lend themselves well to the use of this geometry, resulting in an improved I-beam section with the spar 910 that sports concavely opposed flanges 1010 and 1020. Exemplary embodiments represent the first implementation of such geometry for the purposes of sabot mass reduction in a high-performance gun system, specifically a railgun system in this disclosure. This sabot architecture is unique as a long-felt need, as railgun sabot development has been ongoing for decades, and no such configuration has appeared before.

When viewed from above (as in the upper view 800 of FIG. 8A), the Lightweight I-beam Sabot 310 is further characterized by a thin waist or midsection 620, and comparatively larger fore and aft sections. The large forward section 610 is necessary in order to enable the sabots 310 to achieve sufficient contact interface with the inward arc railgun rails 120 and 130 and vertical insulator planes. The angled forward plane surface 520 of the sabot 310 is also necessary to initiate rapid, controlled separation of the sabots 310 from the projectile 220 under aerodynamic shearing forces at muzzle exit.

The large rear section 630 of the sabot 310 is needed to provide sufficient contact interface at the stern 770 for load transfer with the existing base push structure, including the load transfer interfaces 560 and 570, aft bore rider 230 and armature 240. The mid-section 620 neither experiences high structural loading, nor needs to contact the rails 120 and 130 while hugging the projectile 220. The large, sweeping radii that connect these sections 610, 620 and 630 are employed to provide smooth, gradual transfer of load from each section to the next and prevent stress concentrations which could initiate structural failure.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A sabot of a plurality of angularly distributed segments for shrouding a sub-caliber projectile to form a launch package in a gun bore for acceleration by an actuator behind said projectile, said projectile having a nose tip, each segment of said sabot comprising:

a forecastle that separates the nose tip of the projectile from the gun bore at a radially bow protrusion;

an aft bulkhead that abuts against the actuator; and a waist that longitudinally connects said forecastle and said bulkhead by a radial spar that extends between inner and outer flanges to form an I-beam cross-section, with said inner flange mechanically engaging the projectile and said outer flange radially extending within said bow protrusion, and wherein said outer flange is concave in relation to said spar.

2. The sabot according to claim 1, wherein said inner flange is concave in relation to said spar.

3. The sabot according to claim 1, wherein said forecastle includes a face extending radially outward and forward.

4. The sabot according to claim 1, wherein said forecastle includes a cavity for receiving an insert panel that interfaces with the gun bore.

5. The sabot according to claim 1, wherein said forecastle, waist and bulkhead are composed as a unitary component composed of aluminum alloy.

6. The sabot according to claim 1, wherein said plurality is two.

* * * * *